United States Patent [19]

O'Brien

[11] Patent Number: 4,609,206

[45] Date of Patent: Sep. 2, 1986

[54] BOOK BINDER AND DISPLAY EASEL

[76] Inventor: Walter W. O'Brien, Box 99, R.D. #4, Angie Dr., Hopewell Junction, N.Y. 12533

[21] Appl. No.: 763,613

[22] Filed: Aug. 8, 1985

[51] Int. Cl.[4] ..... A47B 23/00; B42D 1/00

[52] U.S. Cl. ..... 281/33; 281/25 A

[58] Field of Search ..... 281/25, 33; 402/57

[56] References Cited

U.S. PATENT DOCUMENTS

| | | | |
|---|---|---|---|
| 1,522,409 | 1/1925 | Berry | 281/33 |
| 2,523,202 | 9/1950 | Ericson | 281/33 |

FOREIGN PATENT DOCUMENTS

| | | | |
|---|---|---|---|
| 783400 | 4/1968 | Canada | 281/33 |
| 2362145 | 6/1975 | Fed. Rep. of Germany | 281/33 |
| 2363450 | 7/1975 | Fed. Rep. of Germany | 281/33 |
| 2439679 | 5/1980 | France | 281/33 |
| 71047 | 10/1952 | Netherlands | 281/25 A |

*Primary Examiner*—Paul A. Bell
*Assistant Examiner*—Paul M. Heyrana, Sr.
*Attorney, Agent, or Firm*—John Gibson Semmes

[57] ABSTRACT

A book binder which has a cover, convertible to an easel having primary utility for instruction purposes. The book binder is characterized by a combined folding characteristic in the cover together with vertebrate page retainer and anchor hinge therefore. The anchor hinge is offset from the spine of the book and defines an extension strut to limit the angular relation of top and bottom segments of the cover.

2 Claims, 4 Drawing Figures

BOOK BINDER AND DISPLAY EASEL

CROSS REFERENCES TO RELATED APPLICATIONS

None.

BACKGROUND OF INVENTION

1. Field of Invention

This invention is adapted to provide a convertible book form. The contents of which are generally known as loose-leaf pages, portfolios or brochures. The construction of the present book binder is such that upon conversion and during reading reference, the reader-user has access to the contents through forming the invention into a display binder or easel, the forming technique being such as to insure that the loose-leaf page contents retain an essentially flat relationship to a major portion of the cover. A unique combination of offsetting a vertebrated spinal page retainer and its hinge element from the conventional spine of the cover elements yields advantages which will be set forth hereinafter. Whereas the invention is defined with reference to loose-leaf page contents, it will be obvious that it may be adapted to convertible binders which contain conventional folds of pages which are stitched or otherwise permanently secured to each other.

DESCRIPTION OF THE PRIOR ART

The prior art is deemed best represented by the following United States Letters Patent and/or publications: S. G. Johnson, U.S. Pat. No. 1,889,962; E. F. Buenger, et al., U.S. Pat. No. 1,957,039; A. M. Barrett, U.S. Pat. No. Re 21,371; J. A. Brewer, U.S. Pat. No. 2,211,809; E. C. Erickson, U.S. Pat. No. 3,883,209; F. S. Schade, U.S. Pat. No. 2,451,694; H. W. Orth, U.S. Pat. No. 3,334,920; R. C. Cline, U.S. Pat. No. 3,125,356; M. Vernon, U.S. Pat. No. 3,224,792; K. C. Crawford, U.S. Pat. No. 4,355,821; E. T. Holum, U.S. Pat. No. 4,015,863; A. G. Ermanski, et al., U.S. Pat. No. 4,315,696. In addition to the aforesaid, International Business Machines has adapted a loose-leaf binder for its Display Writer Operator Training Systems which serves as an easel.

In general distinction between the following identified invention and the art, the dispostion and storage of respective strut members is critical for the reasons hereinafter recited. In the invention, the hinge strut which secures the binder in the easel configuration is secured to the rear-most cover, not the spine of the back, a portion thereof being fixed atop and the strut portion at the bottom being collapseably secured to the bottom-most portion of the cover. In the device of applicant the loose-leaf, combination vertebrated page retainer and associated hinge element are offset from the binder spine and secured to the rear portion of the cover the same being twice folded upon itself and secured at the bottom, the bottom-most portion of the hinge comprising the strut. One advantage over the art resides in the elimination of page content rigidizing members which are required in prior art combinations.

SUMMARY OF THE INVENTION

The invention is best characterized as a book easel, specifically useful in convertibly securing loose-leaf pages to the cover so that in one form of use, the reader may set the book in a generally acute angular relation to the surface upon which it rests, whereby the reader may form the book into an upright display or book easel, the angular disposition of which is most useful to the reader, whether sitting or standing. Clearly such utility is evident when the reader otherwise has his/her hands occupied in a given task which may comprise instruction within the content of the loose-leaf pages. The ready convertibility has especial utility in such domestic practices as cooking, needlework, horticulture, music, and other forms of creativity. The means of securing the loose-leaf content in situ is offset from the conventional spine of the book cover, for reasons and with the objectives hereinafter set forth. The combination of vertebrated spinal page retainer and supporting hinge with foldable strut, in the offset environment comprises the essence of invention. No expensive rigidizing page supporting centerpiece is required as in the prior art.

DESCRIPTION OF THE PREFERRED EMBODIMENTS

Figure 1:
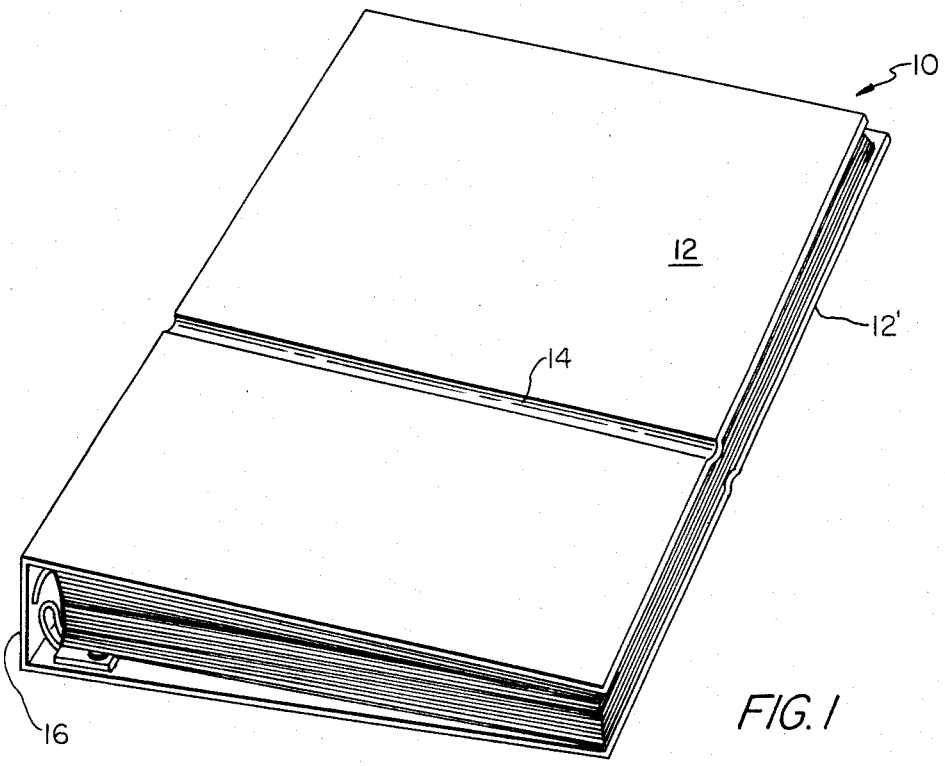
FIG. 1 is a view in perspective of the invention in its folded and storage position.
Figure 2:
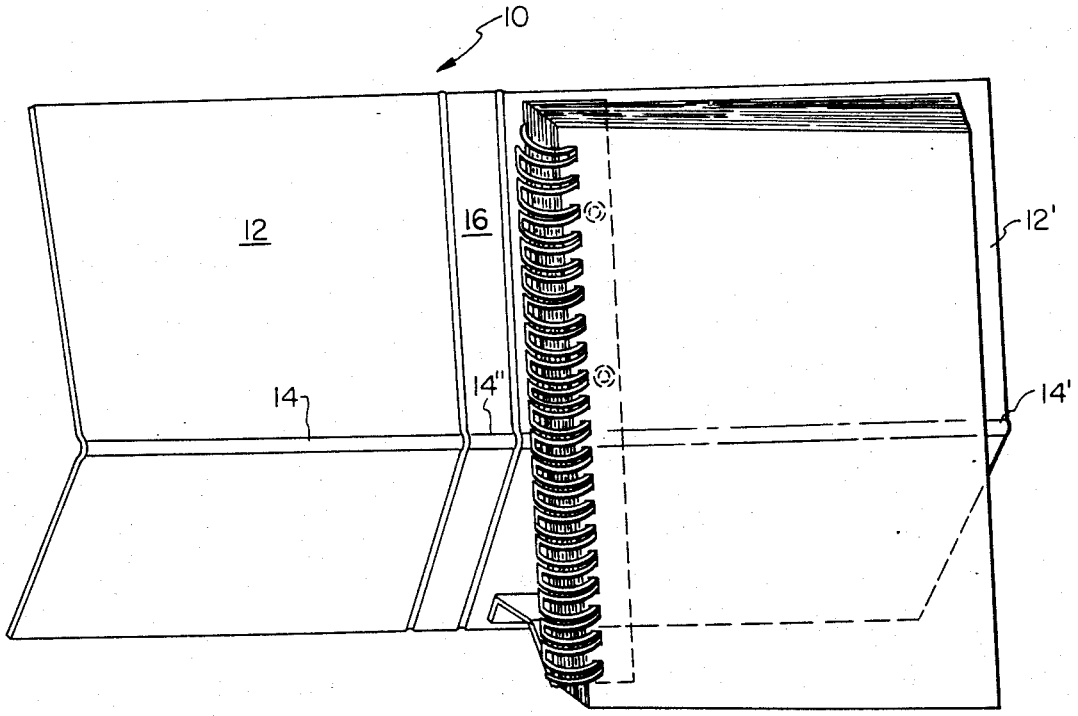
FIG. 2 is an open-exterior view in perspective of the invention, showing the converted mode of utility wherein the easel-effect is demonstrated.
Figure 3:
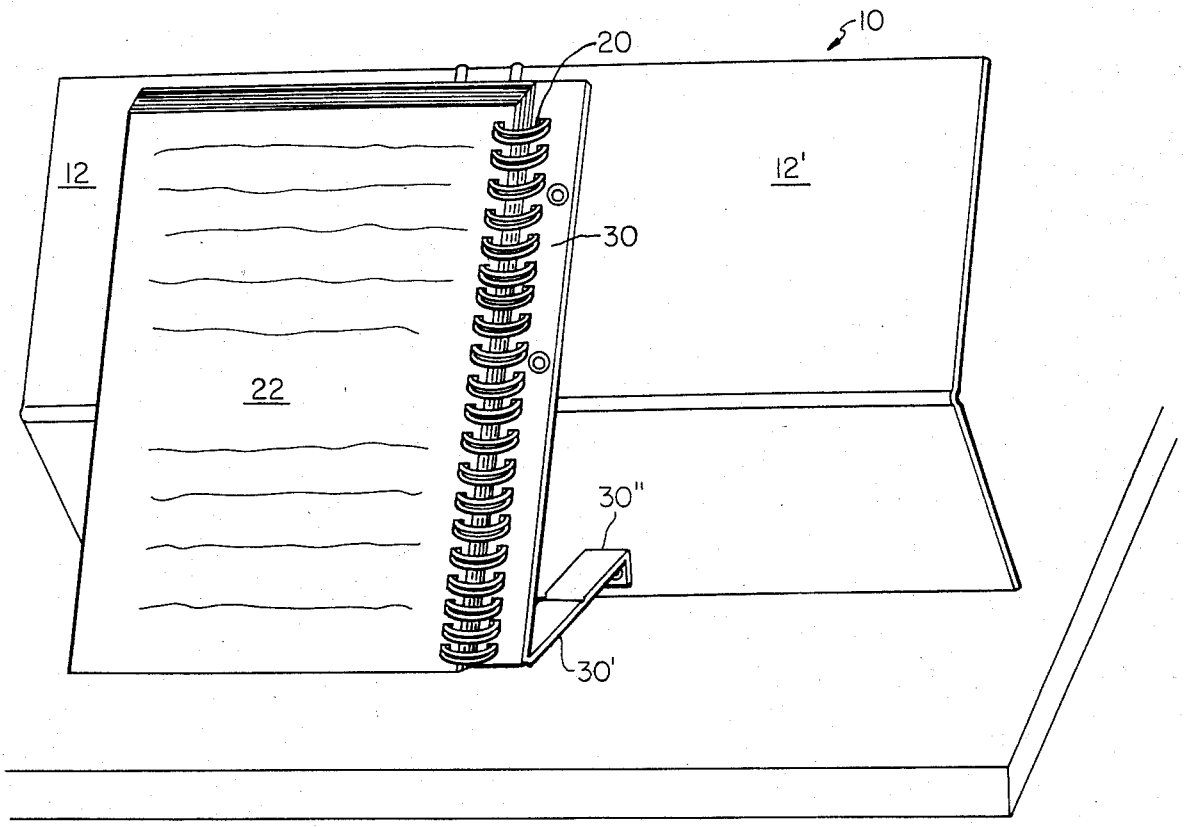
FIG. 3 is an interior-expanded view of the illustration of FIG. 1, depicting the exposed content of the invention, and revealing the offset relationship of the loose-leaf vertebrated page retainer, its hinge support and associated strut.

Book-binder 10 comprises front and rear covers 12 and 12' interconnected by a conventional spine member 16. The covers and spine are respectably indented or scored between the larger area top segment and the smaller area bottom segments by the scorings of 14—14', which extend by interconnection through the spine 16, as indicated at 14''. This scoring indentation comprises a horizontally disposed flexion divider which has the effect of dividing top and bottom segments of the covers and spine into unequal segments, the top segment being of greater dimension than the bottom segment in each instance. This relationship permits the user-reader to fold the bottom segment backwardly, relative to the top segment.

In the invention, as opposed to the prior art, the page retainer and its support are offset laterally from the spine. Thus, a vertebrated spiral page retainer 20 is adapted to secure the page content 22. This vertebrated retainer 20 is adapted to inter-connection with a hinge 30, the hinge being anchored to the rear cover 12' at its topmost segment by rivets or other holding means. It is noteworthy that there is no binding of the hinge at the bottom portion inasmuchas the combination of the vertebrated spiral page retainer and the pages secured thereby are sufficient to rigidize the lowermost and exposed section of the hinge when the book binder has been converted to a display easel. In effect, the hinge defines a first section 30' forming a rear cover anchor for the vertebrated spiral page retainer. This anchor section is secured by riveting to the topmost segment 12' of the book.

Figure 4:
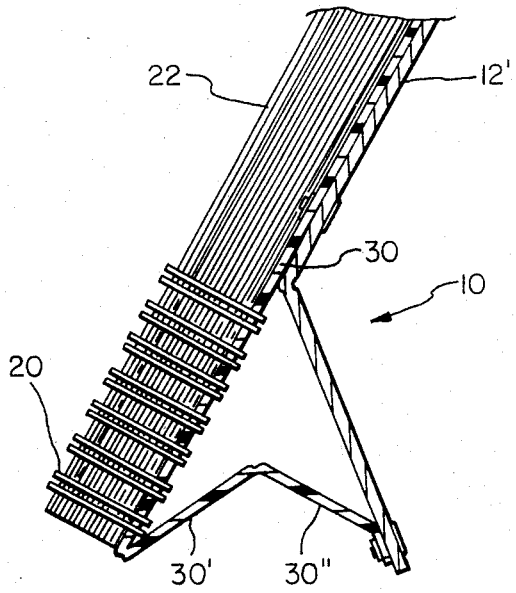
FIG. 4 is a view in side elevation of the construction shown in FIGS. 2 and 3.

Interconnected second and third sections 30' and 30'' are disposed in extension of the first section of the hinge, defining thereby a foldable strut. All sections, first, second and third are joined together by transverse indentations which enhance the folding of the first upon the second, the second upon the third and the third upon its extension, the rear cover, the last mentioned extension being anchored to the rear cover as shown in FIG. 4. The free end of the third section of the hinge 30'' is secured to the bottom segment of the rear cover, all said sections 30, 30' and 30'' being fixed to the rear cover at a location which is offset laterally from the interconnecting spine 16 of the cover, the third section of the hinge being fixed at an end thereof to the lower segment of the rear cover, as shown in FIG. 4. The second and third sections, it will be noted are foldable during the storage of the book in non-use.

The key to the invention resides in the offset disposition of page-supporting elements.

I claim:

1. A book binder, convertible to a display easel, comprising in combination therewith:

(A) front and rear covers, interconnected by a spine, said covers and spine having a horizontally disposed flexion divider, dividing top and bottom of the covers and spine into unequal segments, the top segment being of greater dimension than the bottom segments whereby the bottom segments of the binder and spine may be folded backwardly relative to the top segments thereof;

(B) a rigid hinge defining connected sections, a first section engaging the top of the rear cover and thus defining a rear cover anchor, interconnected second and third sections which are in extension of the first, the second and third sections being separated from the first and each other by a transverse indentation, thus defining a foldable strut which is in extension of said first section, said third section being interconnected by an extension at a free end thereof to the lower segment of the rear cover, all sections of the hinge being retained adjacent the rear cover at a position which is offset laterally from the interconnecting spine of the cover;

(C) a vertebrated spiral page retainer, said vertebrated retainer having fixed connection with the first section of the hinge at a portion which is centrally offset leftward of a centerline drawn vertically through the hinge, adjacent the spine of the covers.

2. The book binder of claim 1 wherein the first section of the hinge has a portion thereof, adjacent the bottom segment of the rear cover which is extendable therefrom forwardly.

* * * * *